US009509062B2

(12) United States Patent
Jervis et al.

(10) Patent No.: US 9,509,062 B2
(45) Date of Patent: Nov. 29, 2016

(54) ALFORD LOOP ANTENNAS WITH PARASITIC ELEMENTS

(71) Applicant: Aruba Networks, Inc., Sunnyvale, CA (US)

(72) Inventors: James W. Jervis, Santa Clara, CA (US); Ahmed Khidre, Cupertino, CA (US); Subburajan Ponnuswamy, Saratoga, CA (US)

(73) Assignee: Aruba Networks, Inc., Sunnyvale, CA (US)

( * ) Notice: Subject to any disclaimer, the term of this patent is extended or adjusted under 35 U.S.C. 154(b) by 168 days.

(21) Appl. No.: 14/471,445

(22) Filed: Aug. 28, 2014

(65) Prior Publication Data

US 2016/0064830 A1 Mar. 3, 2016

(51) Int. Cl.

| | |
|---|---|
| ***H01Q 21/26*** | (2006.01) |
| ***H01Q 1/00*** | (2006.01) |
| ***H01Q 9/28*** | (2006.01) |
| ***H01Q 21/24*** | (2006.01) |

(52) U.S. Cl.

CPC ..... *H01Q 21/26* (2013.01); *H01Q 1/007* (2013.01); *H01Q 9/285* (2013.01); *H01Q 21/24* (2013.01)

(58) Field of Classification Search

CPC ..... H01Q 21/26
USPC ..... 343/797
See application file for complete search history.

(56) References Cited

U.S. PATENT DOCUMENTS 3,605,104 A * 9/1971 Weston ..... H01Q 19/06 343/741

FOREIGN PATENT DOCUMENTS

JP 2009231927 A * 10/2009

* cited by examiner

*Primary Examiner* — Graham Smith
(74) *Attorney, Agent, or Firm* — Brooks, Cameron & Huebsch, PLLC

(57) ABSTRACT

According to one embodiment of the invention, a network device comprises a plurality of antennas comprising a first antenna, wherein the first antenna comprises: a first set of one or more elements that form an Alford loop and that is configured for electrical excitation via a current transmitted over a conductive medium from a signal source and a second set of one or more elements that is configured for electromagnetic induction without contact with the conductive medium from the signal source.

11 Claims, 8 Drawing Sheets

ALFORD LOOP ANTENNAS WITH PARASITIC ELEMENTS

FIELD

Embodiments of the disclosure relate to the field of communications, and in particular, to a wireless network device adapted with a low profile antenna configuration for improved performance.

GENERAL BACKGROUND

Over the last decade or so, electronic devices responsible for establishing and maintaining wireless connectivity within a wireless network have increased in complexity. For instance, wireless electronic devices now support greater processing speeds and greater data rates. As a by-product of this increased complexity, radio communications techniques have evolved with the emergence of multiple-input and multiple-output (MIMO) architectures.

In general, MIMO involves the use of multiple antennas operating as transmitters and/or receivers to improve communication performance. Herein, multiple radio channels are used to carry data within radio signals transmitted and/or received via multiple antennas. In comparison with other conventional architectures, MIMO architectures offer significant increases in data throughput and link reliability. MIMO architectures may utilize a "smart" antenna concept requiring multiple sets of antennas, especially for wireless network products such as an Access Point (AP). The use of smart antennas may improve the reliability and performance of MIMO communication, which may be accomplished with polarization diversity (e.g., horizontal v. vertical) and/or the spatial diversity (e.g., physical location of the antennas within the AP or beam-forming/beam-switching antennas).

However, one disadvantage of MIMO is that multiple antennas traditionally required more space within the AP, which poses some difficulties as it is preferred for indoor APs to have low visual impact as these devices are generally placed in conspicuous places such as mounted to the ceiling. When design constraints limit the area of the AP, low profile antennas may be used to satisfy one or more design constraints. Low profile antennas are placed within close proximity to a ground plane. When an antenna with a horizontally polarized component and a ground plane operate in parallel and within close proximity to each other, the ground plane effectively short circuits the electric field generated by the antenna. This lowers the feedpoint impedance of the antenna, which reduces the efficiency and bandwidth of the antenna. The ground plane also creates an opposing magnetic field that interacts with the magnetic field of the antenna. Therefore, the impact of utilizing a low profile antenna is that the proximity of the ground plane reduces the useful voltage standing wave ratio (VSWR) bandwidth and lowers the efficiency of the antenna.

It would be advantageous if the impact of the proximity of the ground plane to the low profile antenna was negated and therefore did not impact the antenna's bandwidth.

BRIEF DESCRIPTION OF THE DRAWINGS

The disclosure may best be understood by referring to the following description and accompanying drawings that are used to illustrate embodiments of the disclosure.

DETAILED DESCRIPTION

Figure 1:
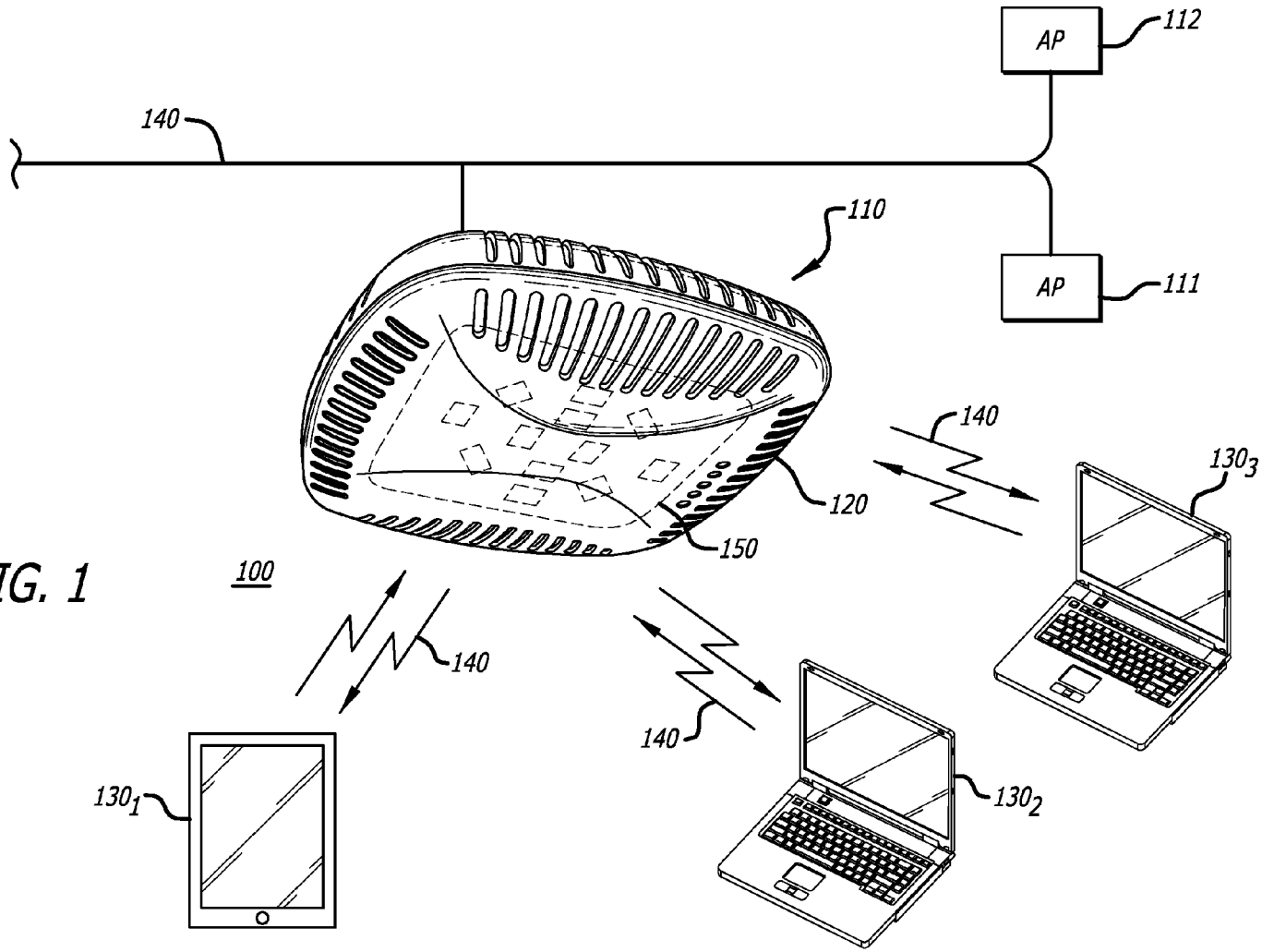
FIG. 1 is an exemplary embodiment of a wireless network including a wireless network device deploying an antenna array assembly.

Embodiments of the disclosure relate to a wireless network device configured with a plurality of low profile antennas, wherein at least one horizontally or elliptically polarized antenna is electromagnetically coupled to a parasitic element.

According to one embodiment of the disclosure, the antenna array assembly comprises an antenna array and a substrate (e.g., a ground plane) onto which the antenna array is placed. The "substrate" of the antenna array assembly may comprise a thin layer of conductive material, for example, but not limited or restricted to, copper, silver and/or aluminum. Alternatively, the substrate may comprise a printed circuit board that includes multiple layers of different materials. The "antenna array" may be a collection of low profile antennas including Alford loop antennas, semi- or full-loop antennas and/or monopole antennas. Throughout the application, unless otherwise stated, the term "Alford loop antenna" should be interpreted as a low profile Alford loop antenna or any low profile antenna operating in a manner similar to an Alford loop antenna. In communication with the wireless logic (e.g., processing circuitry), these low profile antennas allow the AP to achieve a thin, inconspicuous form factor.

In one embodiment, the antenna array assembly may be encapsulated within an Access Point (AP), wherein design requirements placed on the AP may impose certain size constraints on the antenna array assembly. For example, design constraints may require that the height of any antenna included in the antenna array be a maximum height of 12 millimeters (mm) as measured from the ground plane. In a second embodiment, any antenna included in the antenna array may be limited to a maximum height of 10 mm as measured from the ground plane.

In addition, at least one antenna of the antenna array may be horizontally or elliptically polarized and electromagnetically coupled to a parasitic element. The electromagnetic coupling of the parasitic element and the horizontally polarized antenna may act to negate the impact of the close proximity of the ground plane to the Alford loop antenna and allow the Alford loop antenna to operate at full bandwidth.

I. Terminology

In the following description, certain terminology is used to describe features of the disclosure. For example, the term "logic" is generally defined as hardware and/or software. As hardware, logic may include circuitry such as processing circuitry (e.g., a microprocessor, a programmable gate array, a controller, an application specific integrated circuit, controller, etc.), wireless receiver, transmitter and/or transceiver circuitry, semiconductor memory, decryption circuitry, and/or encryption circuitry.

A "wireless network device" generally represents an electronic unit that supports wireless communications such as an Access Point (AP), a bridge, a data transfer device (e.g., wireless network switch, wireless router, router, etc.), or the like.

An "interconnect" is generally defined as a communication pathway established over an information-carrying medium. This information-carrying medium may be a physical medium (e.g., electrical wire, optical fiber, cable, bus traces, etc.), a wireless medium (e.g., air in combination with wireless signaling technology), or a combination thereof.

The term "parasitic element" should be defined as a conductive element of an antenna, such as a strip of metal that is not electrically connected to any other portion of the antenna but located in close proximity to one or more dipoles of the antenna. The lack of a physical connection may result in a coupling, e.g., electromagnetic coupling, between the two circuit elements. For example, a parasitic element may be a parasitic resonator located within close proximity to an antenna element wherein the parasitic resonator is electromagnetically coupled to the antenna element (e.g., the dipole of an antenna). Throughout the specification and claims, the terms "parasitic element" and "parasitic resonator" are used interchangeably.

The term "circular polarization" of an antenna may be defined as the polarization of an antenna having a radiofrequency (RF) signal that is split into two equal amplitude components that are in phase quadrature (at 90 degrees) and are spacially oriented perpendicular to each other and to the direction of propagation.

The term "elliptical polarization" of an antenna may be defined as the polarization of an antenna having a RF signal that has deviated from being circularly polarized. For example, an elliptically polarized antenna may transmit a RF signal having two components that are not equal in amplitude, are not in phase quadrature and/or are not spacially orthogonal.

The term "linear polarization" of an antenna may be defined as the polarization of an antenna having a RF signal wherein the phase difference of one component of the RF signal is equal to zero. The term "vertical polarization" of an antenna may be defined as a linearly polarized antenna having an electric field that is directed 90 degrees away from the earth's surface. In contrast, the term "horizontal polarization" of an antenna may be defined as a linearly polarized antenna having an electric field that is directed parallel to the earth's surface. A linearly polarized antenna may have an electric field that is directed at an angle other than 90 degrees away from the earth's surface (for example, 88 degrees away from the earth's surface).

Lastly, the terms "or" and "and/or" as used herein are to be interpreted as inclusive or meaning any one or any combination. Therefore, "X, Y or Z" or "X, Y and/or Z" mean "any of the following: X; Y; Z; X and Y; X and Z; Y and Z; X, Y and Z." An exception to this definition will occur only when a combination of elements, functions, steps or acts are in some way inherently mutually exclusive.

Certain details are set forth below in order to provide a thorough understanding of various embodiments of the disclosure, albeit the invention may be practiced through many embodiments other that those illustrated. Well-known logic and operations are not set forth in detail in order to avoid unnecessarily obscuring this description.

II. Network Architecture

Referring to FIG. 1, an exemplary embodiment of a network 100 implemented with a wireless network device 110 deploying an antenna array assembly 150 is shown. In accordance with one embodiment of the disclosure, network 100 operates as a wireless local area network (WLAN) that features one or more wireless network devices, such as access points (APs) 110-112 for example.

As shown in this embodiment, AP 110 comprises logic, implemented within a cover 120, that controls wireless communications with other wireless network devices $\mathbf{130}_1$-$\mathbf{130}_r$ (where r≥1, r=3 for this embodiment) and/or wired communications over interconnect 140. Although not shown, interconnect 140 further provides connectivity for network resources such as servers for data storage, web servers, or the like. These network resources are available to network users via wireless network devices $\mathbf{130}_1$-$\mathbf{130}_r$ of FIG. 1, albeit access may be restricted. It should be noted that the cover 120 shown in FIG. 1 is only an illustrative embodiment. The mold of the cover 120 may take any shape or form and may also be subject to design constraints regarding, in particular, size and heat dissipation.

More specifically, for this embodiment of the disclosure, each AP 110-112 supports bi-directional communications by receiving wireless messages from STAs $\mathbf{130}_1$-$\mathbf{130}_r$ within its coverage area. For instance, as shown as an illustrative embodiment of a network configuration, wireless network devices $\mathbf{130}_1$ may be associated with AP 110 and communicates over the air in accordance with a selected wireless communications protocol. Hence, AP 110 may be adapted to operate as a transparent bridge connecting together a wireless and wired network.

Of course, in lieu of providing wireless transceiver functionality, it is contemplated that AP 110 may only support unidirectional transmissions thereby featuring only receive (RX) or transmit (TX) functionality.

The antenna array assembly 150 is shown to include a plurality of antennas, illustrated as dashed rectangular objects. The configuration of the antennas on the antenna array assembly 150 comprises one embodiment of locations in which each antenna of the plurality of antennas may be placed.

III. Wireless Network Device With Antenna Array Assembly

Figure 2:
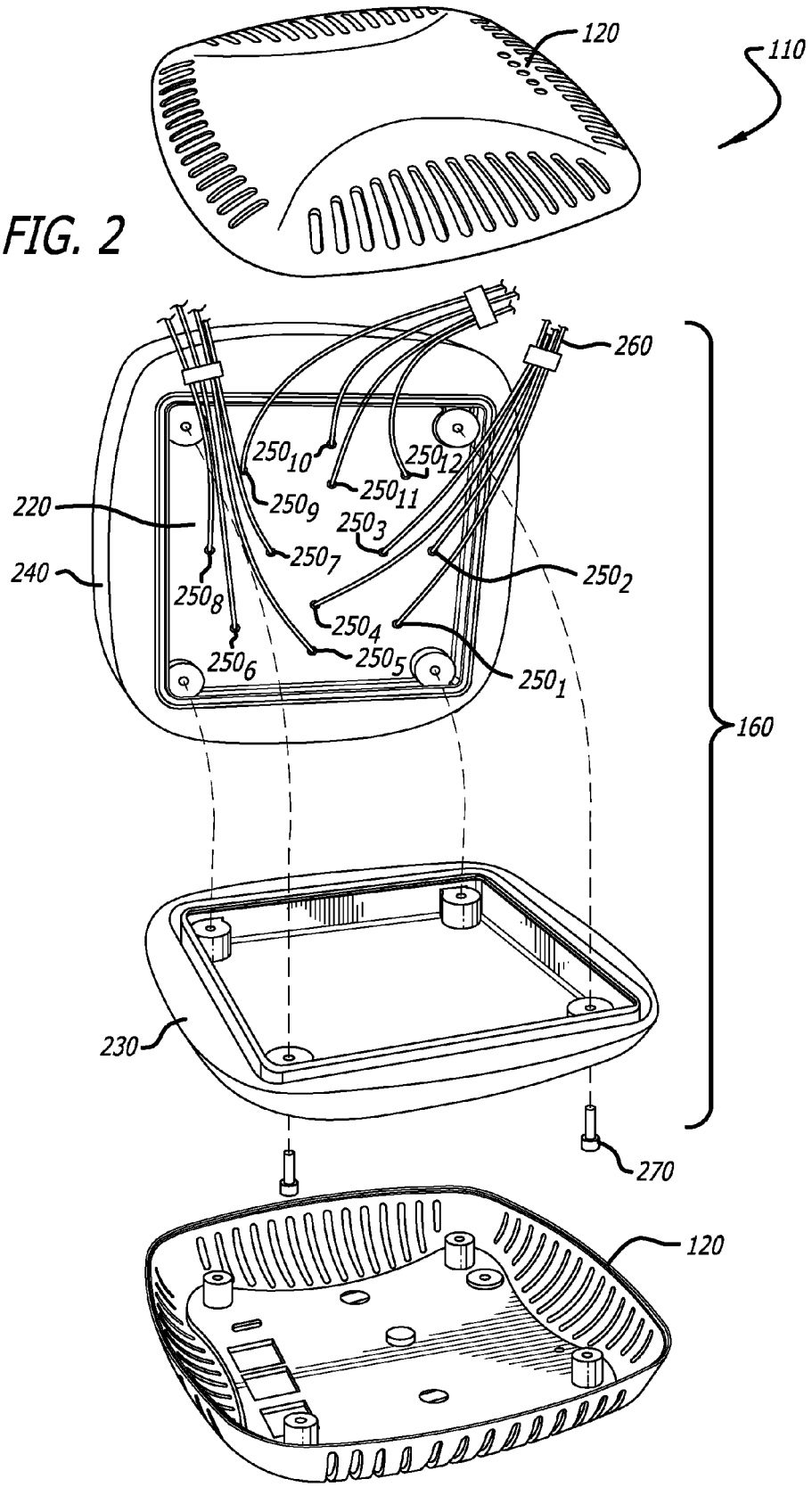
FIG. 2 is an exploded view of a first exemplary embodiment of the wireless network device of FIG. 1.

Referring now to FIG. 2, an exploded view of an exemplary embodiment of wireless network device 110 (e.g., AP 110) of FIG. 1 is shown. Herein, AP 110 comprises a cover 120 that encloses a housing 160 that contains the antenna array assembly 150. According to this embodiment of the disclosure, the housing 160 comprises a base section 230 and a cover section 240. The base section 230 and the cover section 240 may be secured by one or more fastening elements 270 (e.g., boss and screw/bolt, lock and insertion pin, light adhesive, etc.). The underside 220 illustrates the underside portion of the ground plane of the antenna array assembly 150 shown in FIG. 3. The entry points $\mathbf{250}_1$-$\mathbf{250}_M$ (M≥1, M=12 for this embodiment) illustrate the points of entry through which one or more interconnects (e.g. cables) 260 enter the underside 220 in order to supply power to the antennas positioned atop the antenna array assembly 150.

Although not illustrated in FIG. 2, the base section 230 may include wireless logic communicatively coupled to the antennas positioned atop the antenna array assembly 150. The wireless logic may receive data through electrical signals from the antennas and may transmit electrical signals to the antennas.

In one embodiment, both the base section 230 and the cover section 240 may be made of a heat-radiating material in order to dissipate heat by convection. For example, this heat-radiating material may include aluminum or any other metal, combination of metals or a composite that conducts heat.

Figure 3:
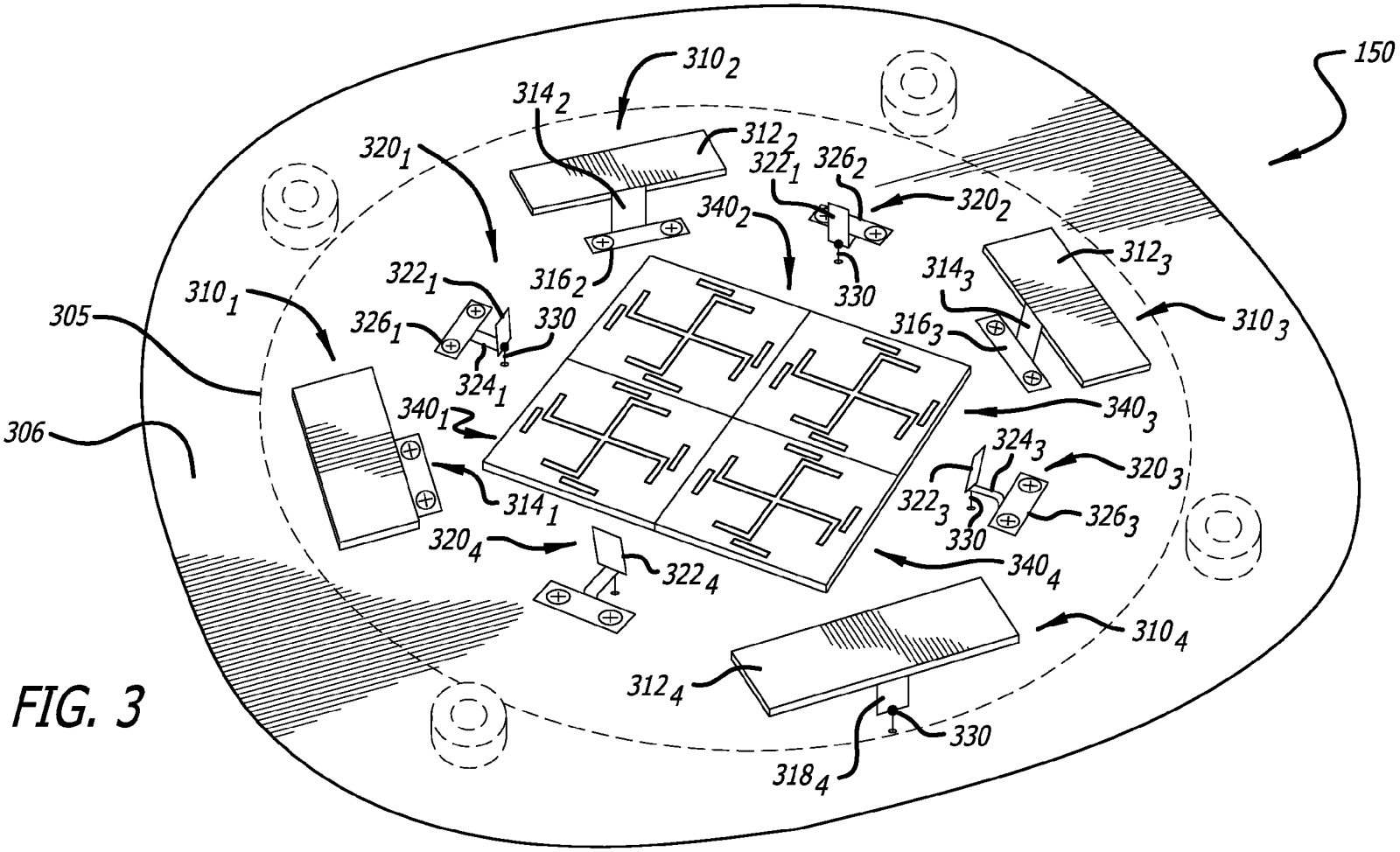
FIG. 3 is a perspective view of an antenna array assembly of the wireless network device of FIG. 1.

Referring to FIG. 3, a perspective view of the antenna array assembly 150 is shown. The antenna array assembly 150 includes an antenna array 305 and a ground plane 306. In this embodiment, three types of antennas are positioned on the topside of the antenna array assembly 150: (1) the semi-loop antennas $\mathbf{310}_1$-$\mathbf{310}_4$, (2) the monopole antennas $\mathbf{320}_1$-$\mathbf{320}_4$ and (3) the Alford loop antennas $\mathbf{340}_1$-$\mathbf{340}_4$. However, other embodiments may contain only one or two types of the above referenced antennas. Power is supplied to each antenna via an interconnect such as power cables 330 for example. In the embodiment of FIG. 3, the semi-loop antennas $\mathbf{310}_1$-$\mathbf{310}_4$ and the monopole antennas $\mathbf{320}_1$-$\mathbf{320}_4$ are positioned in alternating fashion surrounding the Alford loop antennas $\mathbf{340}_1$-$\mathbf{340}_4$. Also, the monopole antennas $\mathbf{320}_1$-$\mathbf{320}_4$ may be positioned further from the edge of the ground plane 160 than the semi-loop antennas $\mathbf{310}_1$-$\mathbf{310}_4$. The power cables 330 supply current to the antennas that results in an excitation of electrons on each antenna (e.g., results in an electrical excitation). The current supplied to the antennas can be said to "electrically induce" the antennas.

In one embodiment, the semi-loop antennas $\mathbf{310}_1$-$\mathbf{310}_4$ may be vertically or elliptically polarized, the monopole antennas $\mathbf{320}_1$-$\mathbf{320}_4$ may be vertically or elliptically polarized and the Alford loop antennas $\mathbf{340}_1$-$\mathbf{340}_4$ may be horizontally or elliptically polarized. The determination of the number of horizontally and/or elliptically polarized antennas included in the antenna array 305 compared to the number of vertically or elliptically polarized antennas may be made based on several factors, including the size of the antennas. In one embodiment, as seen in FIG. 3, each horizontally and/or elliptically polarized Alford loop antenna $\mathbf{340}_1$-$\mathbf{340}_4$ covers a larger surface area on the antenna array assembly 150 than each of the vertically or elliptically polarized semi-loop antennas $\mathbf{310}_1$-$\mathbf{310}_4$ and monopole antennas $\mathbf{320}_1$-$\mathbf{320}_4$.

Each semi-loop antenna $\mathbf{310}_1$-$\mathbf{310}_4$ includes a top surface $\mathbf{312}_1$-$\mathbf{312}_4$, a first leg $\mathbf{314}_1$-$\mathbf{314}_4$, a base member $\mathbf{316}_1$-$\mathbf{316}_4$ and a second leg $\mathbf{318}_1$-$\mathbf{318}_4$. The base member $\mathbf{316}_1$ connects the semi-loop antenna $\mathbf{310}_1$ to the ground plane 306 of the antenna array assembly 150. The first leg $\mathbf{314}_1$ connects the top surface $\mathbf{312}_1$ to the base member $\mathbf{316}_1$. In the current embodiment, the length of the base member $\mathbf{316}_1$ is smaller than that of the top surface $\mathbf{312}_1$. The second leg $\mathbf{318}_1$ is attached to the top surface $\mathbf{312}_1$ but does not come in contact with the ground plane 306 of the antenna array assembly 150. The power cable 330 connects to the second leg $\mathbf{318}_1$ to supply power to the semi-loop antenna $\mathbf{310}_1$. For each semi-loop antenna $\mathbf{310}_1$-$\mathbf{310}_4$, the power cables 330 are configured such no connection is established between the second legs $\mathbf{318}_1$-$\mathbf{318}_4$ and the ground plane 306 through a physical medium.

Each monopole antenna $\mathbf{320}_1$-$\mathbf{320}_4$ includes a vertical surface $\mathbf{322}_1$-$\mathbf{322}_4$, a second leg $\mathbf{324}_1$-$\mathbf{324}_4$ and a base member $\mathbf{326}_1$-$\mathbf{326}_4$. The base member $\mathbf{326}_1$ connects the monopole antenna $\mathbf{320}_1$ to the ground plane 306 of the antenna array assembly 150. The second leg $\mathbf{324}_1$ connects the vertical surface $\mathbf{322}_1$ to the base member $\mathbf{326}_1$. The second leg $\mathbf{324}_1$ is positioned above the ground plane 306. In one embodiment, the second leg $\mathbf{324}_1$ may be positioned one millimeter above the ground plane 306. The power cable 330 connects to the vertical surface $\mathbf{322}_1$ to supply power to the monopole antenna $\mathbf{320}_1$.

In the embodiment shown in FIG. 3, four Alford loop antennas $\mathbf{340}_1$-$\mathbf{340}_4$ are positioned in a square configuration at the center of the ground plane 306 of the antenna array assembly 150. The Alford loop antenna $\mathbf{340}_1$ will be discussed in further detail below.

In one embodiment, the semi-loop antennas $\mathbf{310}_1$-$\mathbf{310}_4$ may be vertically or elliptically polarized and configured to operate on the 2.4 GHz frequency band, the monopole antennas $\mathbf{320}_1$-$\mathbf{320}_4$ may be vertically or elliptically polarized and configured to operate on the 5 GHz frequency band and the Alford loop antennas $\mathbf{340}_1$-$\mathbf{340}_4$ with the parasitic elements may be horizontally or elliptically polarized and configured to operate on the 5 GHz frequency band. Alternative embodiments may comprise an assortment of combinations of the antennas having different polarizations and/or operating on different frequency bands (e.g., the semi-loop antennas $\mathbf{310}_1$-$\mathbf{310}_4$ may be configured to operate on the 5 GHz frequency band).

Figure 4:
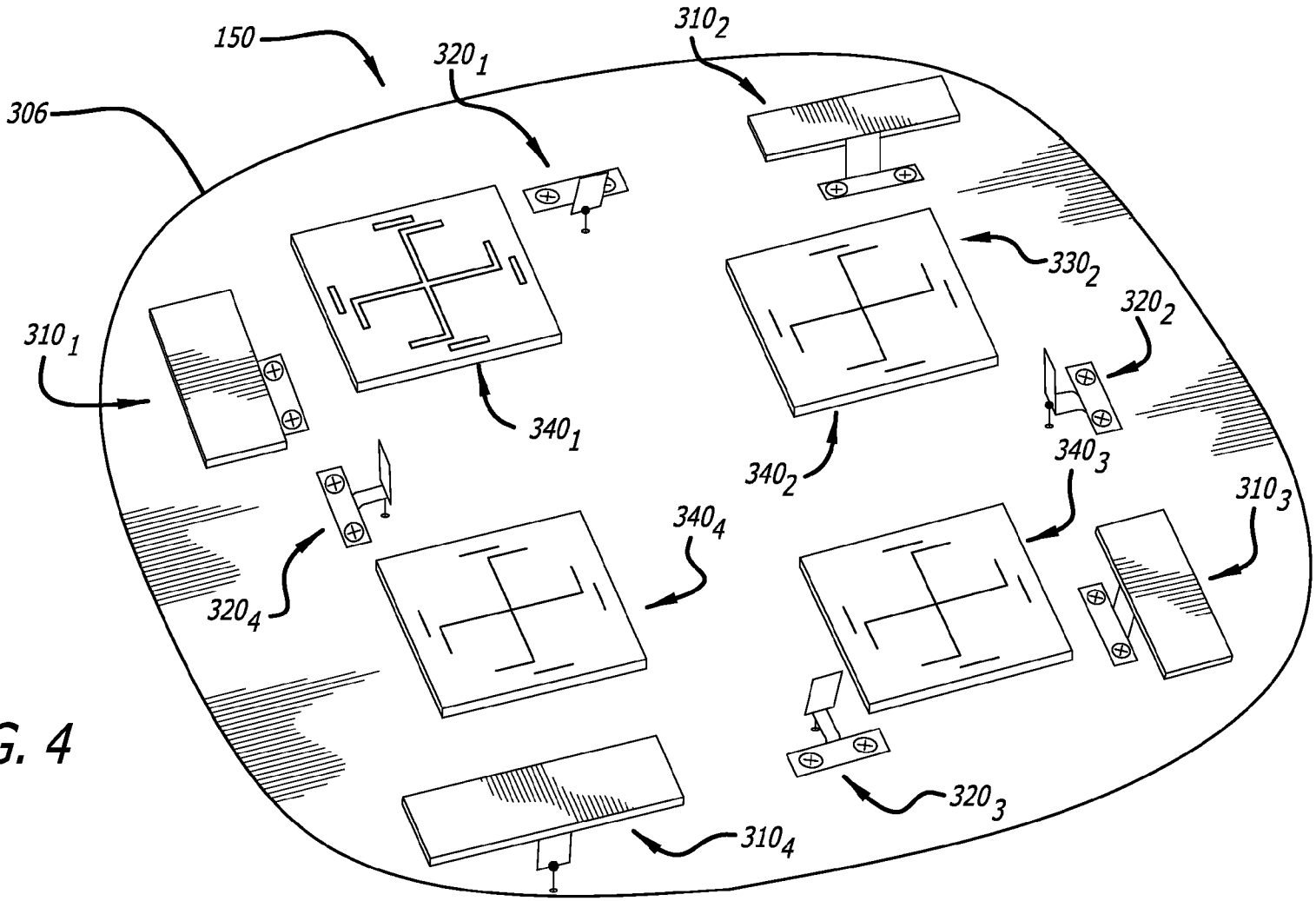
FIG. 4 is a second exemplary perspective view of the topside of the antenna array assembly of FIG. 3.

Referring to FIG. 4, a second exemplary perspective view of the antenna array assembly 150 is shown. The configuration of the semi-loop antennas $\mathbf{310}_1$-$\mathbf{310}_4$, the monopole antennas $\mathbf{320}_1$-$\mathbf{320}_4$ and the Alford loop antennas $\mathbf{340}_1$-$\mathbf{340}_4$ in FIG. 4 illustrates an alternative embodiment of positioning for the antennas than the positioning illustrated in FIG. 3. Herein, the monopole antennas $\mathbf{320}_1$-$\mathbf{320}_4$ are positioned between neighboring Alford loop antenna $\mathbf{340}_1$-$\mathbf{340}_4$, with each semi-loop antennas $\mathbf{310}_1$-$\mathbf{310}_4$ positioned between different edges of the ground plane 306 and a dipole of a corresponding Alford loop antenna $\mathbf{340}_1$-$\mathbf{340}_4$ facing that edge of the ground plane 306.

Figure 5A:
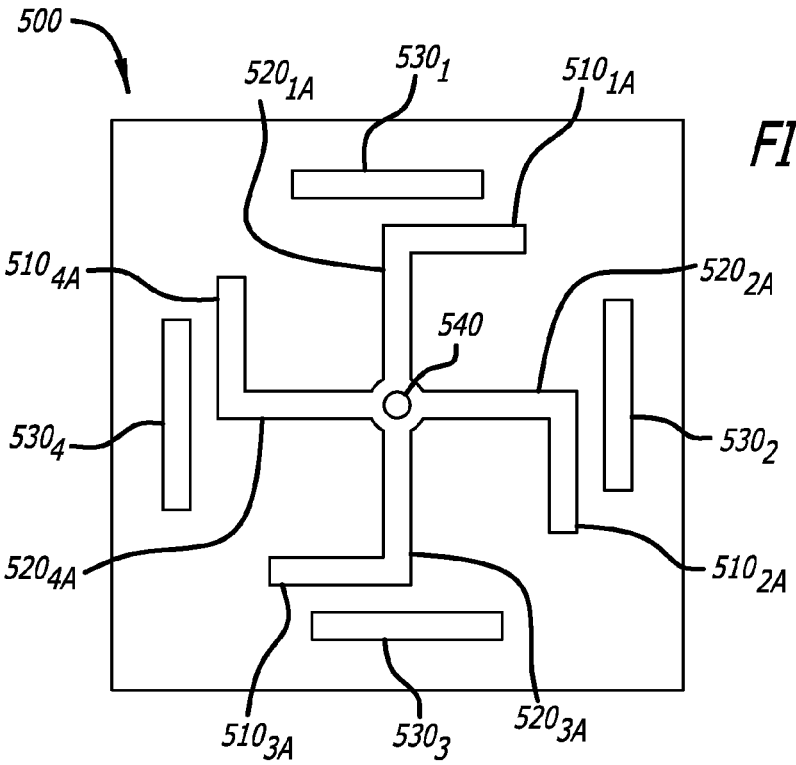
FIGS. 5A and 5B are illustrations of the top and bottom sides of an exemplary embodiment of an Alford loop antenna including parasitic elements.
Figure 5B:
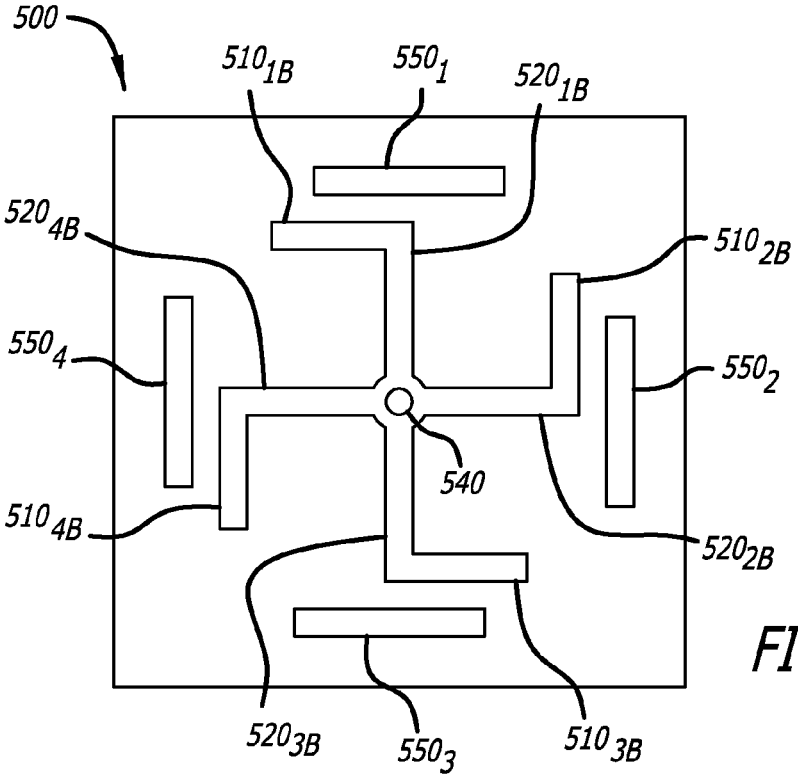

Referring to FIG. 5A, an exemplary illustration of a first side of an Alford loop antenna 500, which is the radiating portion of the Alford loop antenna $\mathbf{340}_1$, is shown. The topside of the Alford loop antenna 500 includes the first side of the dipoles $\mathbf{510}_{1A}$-$\mathbf{510}_{4A}$ while the corresponding second side of each dipole is illustrated in FIG. 5B. In one embodiment, the first side of the dipoles $\mathbf{510}_{1A}$-$\mathbf{510}_{4A}$ may represent the positive side of each dipole of the Alford loop antenna 500. The topside of the Alford loop antenna 500 of FIG. 5A also includes feed lines $\mathbf{520}_{1A}$-$\mathbf{520}_{4A}$ that distribute power from the feedpoint 540 to the first side of the dipoles $\mathbf{510}_{1A}$-$\mathbf{510}_{4A}$. The topside of the Alford loop antenna 500 also includes the parasitic elements $\mathbf{530}_1$-$\mathbf{530}_4$. Each of the parasitic elements $\mathbf{530}_1$-$\mathbf{530}_4$ corresponds to a first side of a dipole $\mathbf{510}_{1A}$-$\mathbf{510}_{4A}$. In one embodiment, the parasitic elements $\mathbf{530}_1$-$\mathbf{530}_4$ included in the Alford loop antenna 500 may be configured as half-wavelength resonators.

Referring to FIG. 5B, the bottom side of the Alford loop antenna 500 of FIG. 5A is shown. The bottom side of the Alford loop antenna 500 includes elements corresponding to elements included on the topside of the Alford loop 500 of FIG. 5A. The feed lines $\mathbf{520}_{1B}$-$\mathbf{520}_{4B}$ are positioned in direct correlation by being positioned directly under and vertically planar to the feed lines $\mathbf{520}_{1A}$-$\mathbf{520}_{4A}$ of FIG. 5A, respectively. Similarly, the parasitic elements $\mathbf{550}_1$-$\mathbf{550}_4$ are positioned in direct correlation to the parasitic elements $\mathbf{530}_1$-$\mathbf{530}_4$ of FIG. 5A, respectively. In contrast, the dipoles $\mathbf{510}_{1B}$-$\mathbf{510}_{4B}$ are not in direct correlation, but rather, are positioned planar to dipoles $\mathbf{510}_{1A}$-$\mathbf{510}_{4A}$ but shifted so that a substantial portion of the dipoles $510_{1B}$-$510_{4B}$ do not reside directly below $510_{1A}$-$510_{4A}$. In one embodiment, the second side of each dipole $510_{1B}$-$510_{4B}$ may represent the negative side of each dipole of the Alford loop antenna 500. Alternatively, the second side of each dipole $510_{1B}$-$510_{4B}$ may represent the positive side of each dipole of the Alford loop antenna 500 while the second side of each dipole $510_{1A}$-$510_{4A}$ represents the negative side.

As discussed above, the close proximity of a low profile antenna to the ground plane (e.g., a horizontally or elliptically polarized Alford loop antenna 500 having a maximum height of 12 mm as measured from the ground plane) acts to short circuit the dipoles $510_1$-$510_4$ of the Alford loop antenna 500 by generating capacitance between the Alford loop antenna and the ground plane. The generated capacitance narrows the bandwidth of the Alford loop antenna 500 and also decreases its efficiency.

When parasitic elements $530_1$-$530_4$ are placed in close proximity to the dipoles $510_1$-$510_4$ of the Alford loop antenna 500 and are void of any direct power connections, the parasitic elements $530_1$-$530_4$ will electromagnetically couple to the Alford loop antenna 500 (specifically, the dipoles $510_1$-$510_4$ of the Alford loop antenna 500). The combination of the capacitance generated by the dipoles $510_1$-$510_4$ of the Alford loop antennas and the changing current across the dipoles $510_1$-$510_4$ results in the electromagnetic induction of the parasitic elements $530_1$-$530_4$. When the parasitic elements $530_1$-$530_4$ are electromagnetically coupled to the Alford loop antenna 500, the parasitic elements $530_1$-$530_4$ pull the electric field generated by the dipoles $510_1$-$510_4$ of the Alford loop antenna 500 away from the ground plane thereby allowing the antenna 500 to operate with normal bandwidth radiating in a radial manner away from the AP.

The electromagnetic coupling may also increase the aperture of the antenna 500 therefore increasing the antenna's bandwidth. In addition, the electromagnetic coupling may also provide the ability to tune the antennas off frequency in relation to the parasitic elements, which may also increase the bandwidth of the antenna 500. In one embodiment, tuning the Alford loop antennas off frequency in relation to the parasitic elements may produce a frequency wave having double the bandwidth as opposed to the embodiment in which the antennas and parasitic elements are in tune by keeping the first resonance low.

In addition to pulling the electric field of the Alford loop antenna 500 away from the ground plane, the parasitic elements $530_1$-$530_4$ are also able to establish polarization diversity within the AP through the creation of elliptical or linear polarization. This is accomplished by (i) rotating the parasitic resonators out of the plane containing the driven elements (the dipoles of the antennas), (ii) spacing the parasitic resonators, and/or (iii) choosing an appropriate width for the parasitic resonators.

The principle embodied in the example illustrated in FIGS. 5A and 5B provides a distinct technological improvement over previous wireless network devices by enabling low profile Alford loop antennas $340_1$-$340_4$ of FIG. 3 to operate in close proximity to a ground plane 160 while retaining normal bandwidth. Specifically, the effect of the combination of the electrically induced antenna(s) and the electromagnetically induced parasitic elements $530_1$-$530_4$ increases the bandwidth of the low profile Alford loop antenna(s) $340_1$-$340_4$. Therefore, an inconspicuous, low profile AP may be provided using, at least, one or more low profile Alford loop antennas while ensuring the bandwidth of the antennas is not reduced due to the existence of a short circuit between the antenna and the ground plane.

Referring back to FIG. 5A, one goal of the Alford loop antenna 500 is to create an impedance of a predetermined value at the feedpoint 540. In one embodiment, the predetermined value at the feedpoint 540 may be 50 ohms. In order to achieve a value of 50 ohms at the feedpoint 540, the feed lines $520_{1A}$-$520_{4A}$ are configured such that each feed line delivers an impedance of 200 ohms to the feedpoint 540. Since the feed lines $520_{1A}$-$520_{4A}$ are in parallel in this embodiment, the feedpoint impedance of FIG. 5A can be represented as:

$$\frac{1}{Z_{520_1}}+\frac{1}{Z_{520_2}}+\frac{1}{Z_{520_3}}+\frac{1}{Z_{520_4}}=\frac{1}{Z_{feedpoint}}$$

$$\frac{1}{200}+\frac{1}{200}+\frac{1}{200}+\frac{1}{200}=\frac{1}{Z_{feedpoint}}$$

$$Z_{feedpoint}=50\ \Omega$$

The impedance presented at the feedpoint 540 from each feed line $520_{1A}$-$520_{4A}$ can be set by configuring one or more of several factors of each feed line $520_{1A}$-$520_{4A}$ including, but not limited or restricted to, the width of, the length of and/or the separation between the feed lines $520_{1A}$-$520_{4A}$ in the particular dielectric constant medium in which the feed line is located.

Figure 6A:
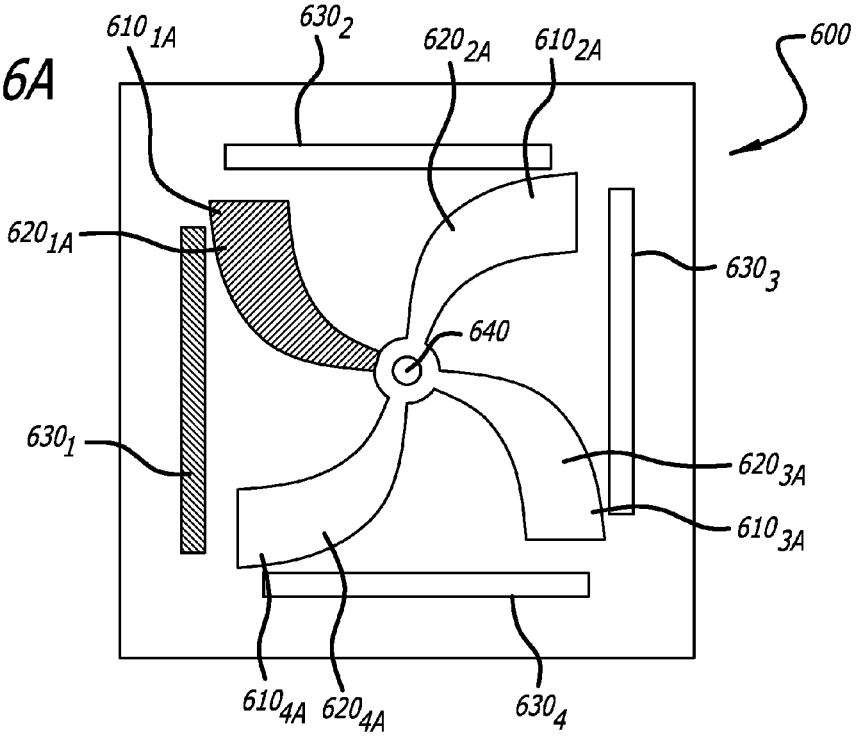
FIGS. 6A and 6B are illustrations of the top and bottom sides of a first alternative exemplary embodiment of an Alford loop antenna including parasitic elements.
Figure 6B:
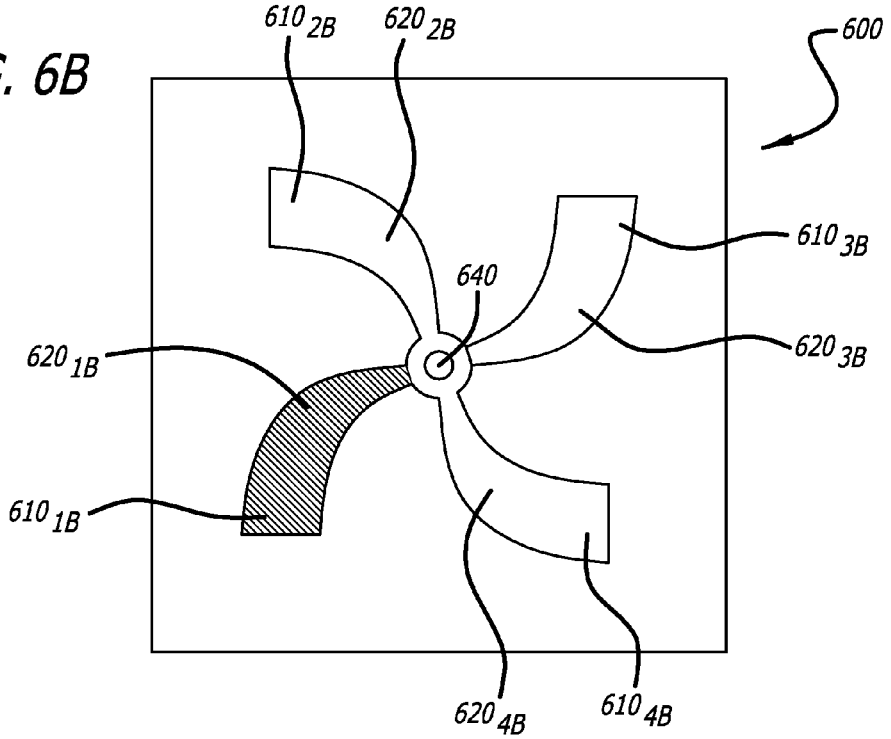

Referring now to FIGS. 6A, 6B, 7A, 7B, 8A and 8B, alternative exemplary embodiments of an Alford loop antenna including parasitic elements are shown. Referring to FIG. 6A, the topside of the Alford loop antenna 600 includes the first side of the dipoles $610_{1A}$-$610_{4A}$ while the corresponding second side of each dipole is illustrated in FIG. 6B. The topside of the Alford loop antenna 600 also includes feed lines $620_{1A}$-$620_{4A}$ that distribute power from the feedpoint 640 to the first side of the dipoles $610_{1A}$-$610_{4A}$. The topside of the Alford loop antenna 600 also includes the parasitic elements $630_1$-$630_4$. Each of the parasitic elements $630_1$-$630_4$ corresponds to a first side of a dipole $610_{1A}$-$610_{4A}$. In one embodiment, the parasitic elements included in the Alford loop antenna 600 may be configured as half-wavelength resonators. The shaded portions of FIG. 6A illustrate the antenna elements (the first side of the dipole $610_{1A}$ and the feed line $620_{1A}$) and the parasitic element $630_1$ that correspond with the shaded portion of FIG. 6B (the antenna elements which include the second side of the dipole $610_{1B}$ and the feed line $620_{1B}$).

Referring to FIG. 6B, the bottom side of the Alford loop antenna 600 includes the second side of the dipoles $610_{1B}$-$610_{4B}$ corresponding to the first side of each dipole is illustrated in FIG. 6A. The bottom side of the Alford loop antenna 600 of FIG. 6B also includes feed lines $620_{1B}$-$620_{4B}$ that distribute power from the feedpoint 640 to the second side of the dipoles $610_{1B}$-$610_{4B}$. In the embodiment of the Alford loop antenna 600 illustrated in FIG. 6B, the bottom side of the Alford loop antenna 600 does not include a plurality of parasitic elements. Instead, the second sides of the dipoles $610_{1B}$-$610_{4B}$ will electromagnetically couple to the parasitic resonators $630_1$-$630_4$ located on the topside of the Alford loop antenna 600 as illustrated in FIG. 6A. Any embodiments, e.g., FIGS. 5A-8B, may include one or more parasitic elements on a single side or both sides of an Alford loop antenna.

Figure 7A:
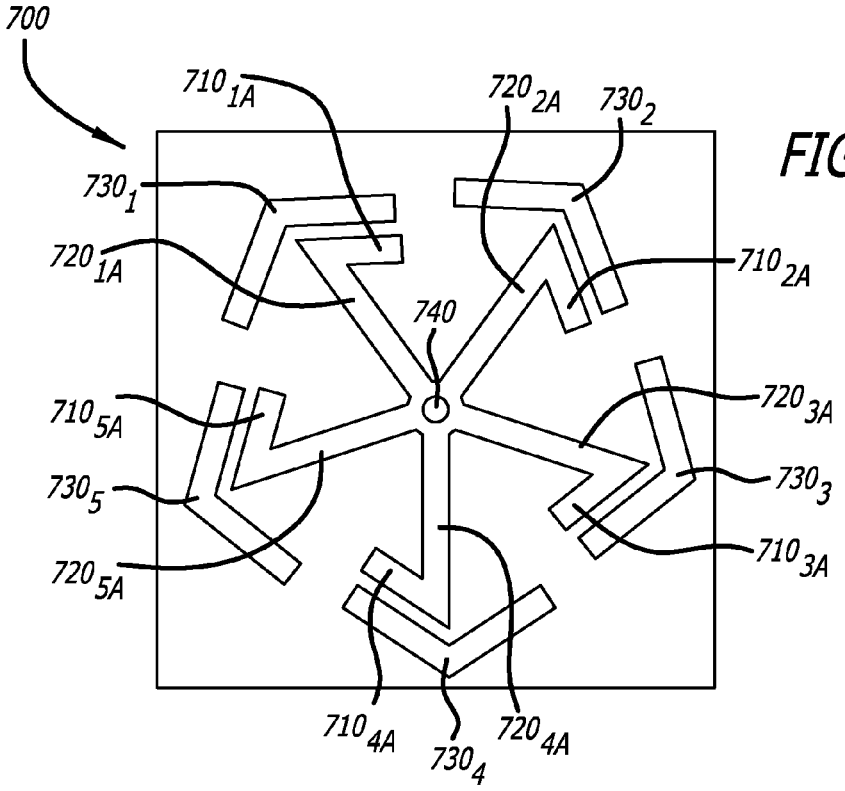
FIGS. 7A and 7B are illustrations of the top and bottom sides of a second alternative exemplary embodiment of an Alford loop antenna including parasitic elements.
Figure 7B:
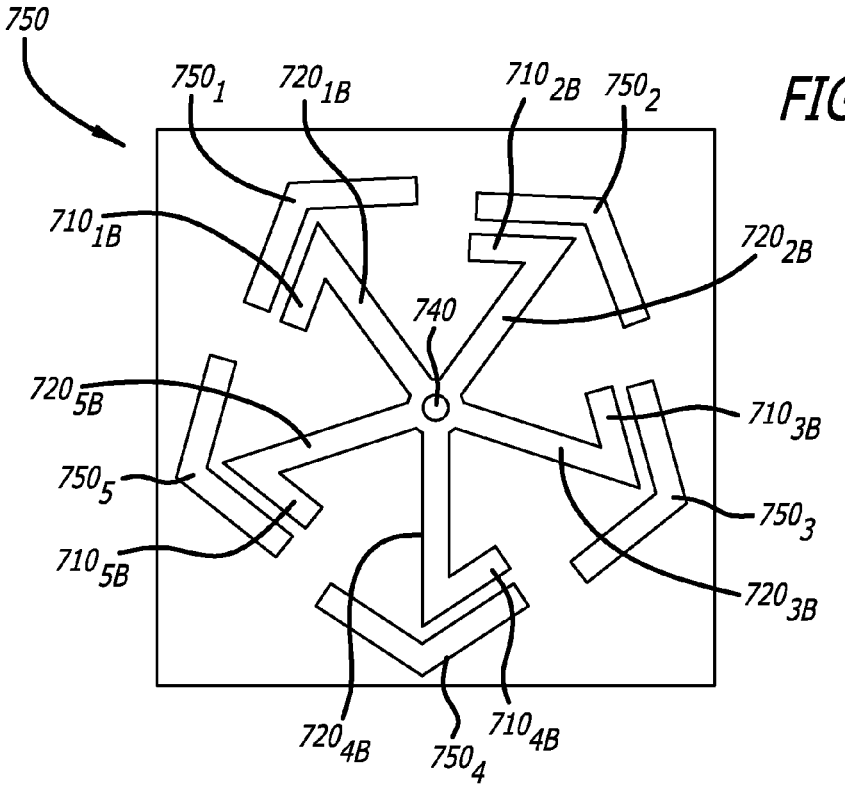

Referring to FIGS. 7A and 7B, a second exemplary alternative embodiment to the Alford loop antenna including parasitic elements of FIGS. 5A and 5B is shown. Referring to FIG. 7A, the topside of the Alford loop antenna 700 includes the first side of the dipoles $\mathbf{710}_{1A}$-$\mathbf{710}_{4A}$ while the corresponding second side of each dipole is illustrated in FIG. 7B. The topside of the Alford loop antenna 700 of FIG. 7A also includes feed lines $\mathbf{720}_{1A}$-$\mathbf{720}_{4A}$ that distribute power from the feedpoint 740 to the first side of the dipoles $\mathbf{710}_{1A}$-$\mathbf{710}_{4A}$. The topside of the Alford loop antenna 700 also includes the parasitic elements $\mathbf{730}_1$-$\mathbf{730}_4$. Each of the parasitic elements $\mathbf{730}_1$-$\mathbf{730}_4$ corresponds to a first side of a dipole $\mathbf{710}_{1A}$-$\mathbf{710}_{4A}$. In one embodiment, the parasitic elements included in the Alford loop antenna 700 may be configured as half-wavelength resonators.

Similarly, referring to FIG. 7B, the bottom side of the Alford loop antenna 700 includes the second side of each dipole $\mathbf{710}_{1B}$-$\mathbf{710}_{4B}$ corresponding to the first side of each dipole as illustrated in FIG. 7A. The bottom side of the Alford loop antenna 700 of FIG. 7B also includes feed lines $\mathbf{720}_{1B}$-$\mathbf{720}_{4B}$ that distribute power from the feedpoint 740 to the second side of the dipoles $\mathbf{710}_{1B}$-$\mathbf{710}_{4B}$. The bottom side of the Alford loop antenna 700 also includes the parasitic elements $\mathbf{750}_1$-$\mathbf{750}_4$. Each of the parasitic elements $\mathbf{750}_1$-$\mathbf{750}_4$ corresponds to a second side of the dipoles $\mathbf{710}_{1B}$-$\mathbf{710}_{4B}$. In one embodiment, the parasitic elements $\mathbf{750}_{1B}$-$\mathbf{750}_{4B}$ included in the Alford loop antenna 700 may be configured as half-wavelength resonators.

Figure 8A:
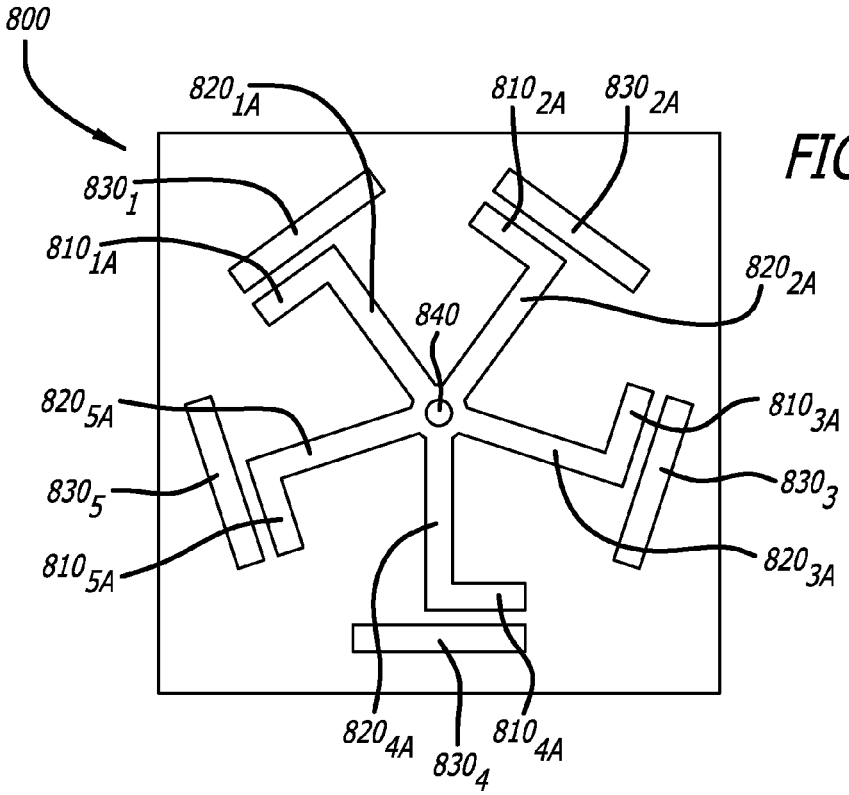
FIGS. 8A and 8B are illustrations of the top and bottom sides of a third alternative exemplary embodiment of an Alford loop antenna including parasitic elements.
Figure 8B:
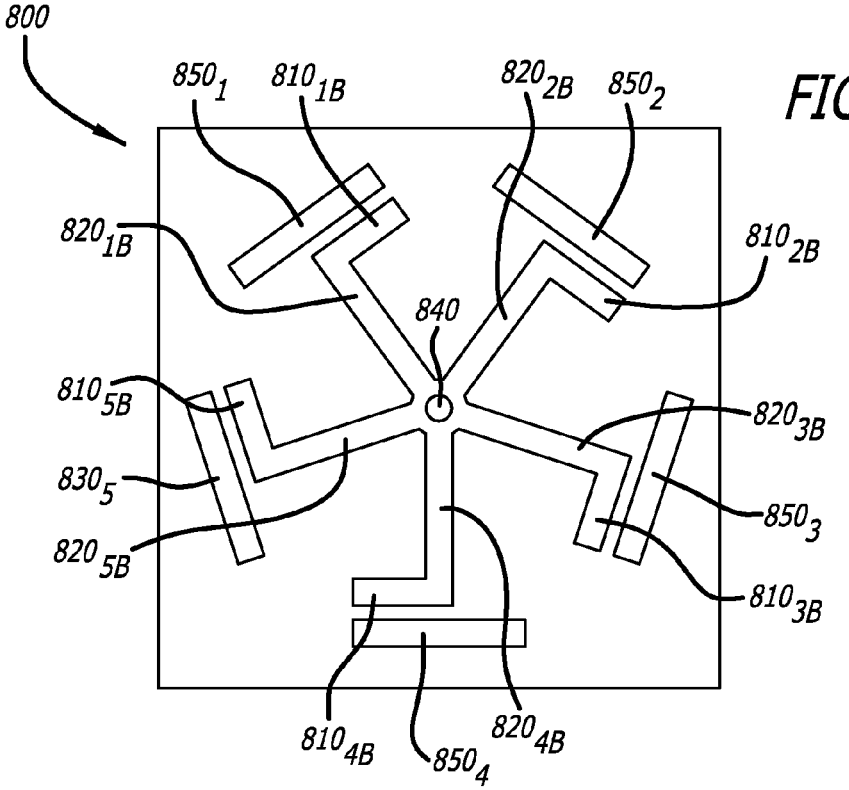

Referring to FIGS. 8A and 8B, an exemplary alternative embodiment to the Alford loop antenna including parasitic elements of FIGS. 5A and 5B is shown. Referring to FIG. 8A, the topside of the Alford loop antenna 800 includes the first side of the dipoles $\mathbf{810}_{1A}$-$\mathbf{810}_{4A}$ while the corresponding second side of each dipole is illustrated in FIG. 8B. The topside of the Alford loop antenna 800 of FIG. 8A also includes feed lines $\mathbf{820}_{1A}$-$\mathbf{820}_{4A}$ that distribute power from the feedpoint 840 to the first side of the dipoles $\mathbf{810}_{1A}$-$\mathbf{810}_{4A}$. The topside of the Alford loop antenna 800 also includes the parasitic elements $\mathbf{830}_1$-$\mathbf{830}_4$. Each of the parasitic elements $\mathbf{830}_1$-$\mathbf{830}_4$ corresponds to a first side of a dipole $\mathbf{810}_{1A}$-$\mathbf{810}_{4A}$. In one embodiment, the parasitic elements included in the Alford loop antenna 800 may be configured as half-wavelength resonators.

Similarly, referring to FIG. 8B, the bottom side of the Alford loop antenna 800 includes the second side of each dipole $\mathbf{810}_{1B}$-$\mathbf{810}_{4B}$ corresponding to the first side of each dipole as illustrated in FIG. 8A. The bottom side of the Alford loop antenna 800 of FIG. 8B also includes feed lines $\mathbf{820}_{1B}$-$\mathbf{820}_{4B}$ that distribute power from the feedpoint 840 to the second side of the dipoles $\mathbf{810}_{1B}$-$\mathbf{810}_{4B}$. The bottom side of the Alford loop antenna 800 also includes the parasitic elements $\mathbf{850}_1$-$\mathbf{850}_4$. Each of the parasitic elements $\mathbf{850}_1$-$\mathbf{850}_4$ corresponds to a second side of the dipoles $\mathbf{810}_{1B}$-$\mathbf{810}_{4B}$. In one embodiment, the parasitic elements $\mathbf{850}_{1B}$-$\mathbf{850}_{4B}$ included in the Alford loop antenna 800 may be configured as half-wavelength resonators.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as determined by the appended claims and their equivalents. The description is thus to be regarded as illustrative instead of limiting.

What is claimed is:

1. A device comprising:

a plurality of antennas comprising an antenna array;

a first antenna among the plurality of antennas, wherein the first antenna includes:

a first set of elements that form an Alford loop, wherein:

the first set of elements are configured for electrical excitation via a current transmitted over a conductive medium from a signal source; and the first set of elements are located in a center of a surface of a medium; and a second set of elements configured for electromagnetic induction without contact with the conductive medium from the signal source, wherein the second set of elements are located in a periphery of the surface of the medium.

2. The device of claim 1, wherein the second set of elements are parasitically coupled elements.

3. The device of claim 1, wherein the second set of elements are configured for electromagnetic induction due to a change in charge and/or an electrical current on the Alford loop.

4. The device of claim 1, wherein the device further comprises a ground plane, and wherein the first set of elements are less than 12 millimeters from the ground plane.

5. The device of claim 4, wherein the second set of elements are less than 12 millimeters from the ground plane.

6. The device of claim 1, wherein the device further comprises a ground plane, and wherein the second set of elements are less than 12 millimeters from the ground plane.

7. The device of claim 1, wherein the second set of elements alters the pattern of the electric field produced by the Alford loop.

8. The device of claim 7, wherein the second set of elements pull the electric field away from a portion of the ground plane directly below the first set of elements.

9. The device of claim 7, wherein the second set of elements enlarges the effective aperture of the first antenna.

10. The device of claim 1, wherein the device is an access point.

11. The device of claim 4, wherein the device includes a second antenna among the plurality of antennas, and wherein:

the second antenna is different from the first antenna; and the second antenna is disposed distal to a center of the ground plane, relative to the first antenna.

* * * * *